US008098157B2

(12) United States Patent
Saunders et al.

(10) Patent No.: US 8,098,157 B2
(45) Date of Patent: Jan. 17, 2012

(54) INTRUDER DETERRENT LIGHTING

(75) Inventors: F. Eric Saunders, Arnold, CA (US); Gregory V. Bailey, Incline Village, NV (US); Nicholas A. Antonopoulos, San Jose, CA (US)

(73) Assignee: VNS Portfolio LLC, Cupertino, CA (US)

( * ) Notice: Subject to any disclaimer, the term of this patent is extended or adjusted under 35 U.S.C. 154(b) by 343 days.

(21) Appl. No.: 12/402,891

(22) Filed: Mar. 12, 2009
(Under 37 CFR 1.47)

(65) Prior Publication Data

US 2010/0271205 A1 Oct. 28, 2010

(51) Int. Cl.
*G08B 13/00* (2006.01)

(52) U.S. Cl. ..... 340/541; 340/551; 340/552; 340/555; 340/565

(58) Field of Classification Search ..... 340/541, 340/551, 552, 555, 565
See application file for complete search history.

(56) References Cited

U.S. PATENT DOCUMENTS

| | | | | |
|---|---|---|---|---|
| 4,191,947 | A * | 3/1980 | Bouchard et al. | 340/531 |
| 2004/0002792 | A1* | 1/2004 | Hoffknecht | 700/295 |
| 2004/0178921 | A1* | 9/2004 | Lawrence | 340/691.1 |
| 2008/0224026 | A1* | 9/2008 | Pasternak | 250/206 |
| 2010/0123414 | A1* | 5/2010 | Antonopoulos | 315/297 |
| 2010/0123570 | A1* | 5/2010 | Antonopoulos et al. | 340/501 |

FOREIGN PATENT DOCUMENTS

| | | | |
|---|---|---|---|
| JP | 2001210476 | A | 8/2001 |
| JP | 2004047346 | A | 2/2004 |
| KR | 1020050097612 | A | 10/2005 |

* cited by examiner

*Primary Examiner* — Travis Hunnings
(74) *Attorney, Agent, or Firm* — Edward P. Heller, III

(57) ABSTRACT

A zoned interactive control area (10) wherein an architectural space is divided in to a plurality of zones (16), each having its own sensor (22) and zone lights (18). In a normal operating mode (50) the sensors (22) are used to detect the presence of a person such that the zone lights (18) can be turned on and/or adjusted for light level. Each zone light (18) also has a light sensor (24) used, at least in part, for communication with the other zone lights (18), such that the light level can be adjusted not just in response to a presence in the respective zone (16) but also in response to presence in other zones (16). According to a security method (70) when the zone lights (18) are not in use for normal lighting (as when they are turned off) then if the sensors (22) detect the presence of an intruder the zone lights (18) flash to deter the intruder and also communicate the fact of the presence of the intruder to the other zone lights (18) via the light sensors (22).

9 Claims, 2 Drawing Sheets

INTRUDER DETERRENT LIGHTING

BACKGROUND OF THE INVENTION

1. Field of the Invention

The present invention relates to the field of automated lighting control systems, and more particularly to lighting that is intended to deter intrusion into a premises. The predominant current usage of the present inventive improved intruder deterrent lighting is as a relatively inexpensive addition or modification to lighting systems that are primarily intended for general illumination purposes.

2. Description of the Background Art

It is known in the art to use lighting to deter burglaries and other types of unwanted intrusions. Since criminals prefer to avoid detection, they would often prefer to go about their business in the dark, where they cannot be seen. In particular, they tend to dislike lights that sense their presence and come on when they approach, thereby both making them visible to others and alerting others who may see the light come on of their presence. Also, since persons who are "up to no good" may be a bit self conscious, the lights coming on may startle them and this, itself, may tend to dissuade them from continuing their nefarious activity.

It is also known in the art that certain types of lighting are more effective than others at causing an individual to cease doing whatever they were doing. A simple example is the Arcturus™ flashlight made by Insight™ company. This flashlight has a bright (130 lumen) beam that is intended to be used for self defense purposes by shining the light into the eyes of an assailant. In a normal mode it shines a steady beam, but in a flashing mode it flashes rapidly. It has been found that the flashing light is much more effective in both deterring and disorienting the assailant.

A more sophisticated example of using light to deter and disorient persons is found in the teachings of U.S. Pat. No. 7,180,426, issued to Rubstov. That patent teaches a method and means for incapacitating persons and/or animals using light.

Finally, it is also known to connect lights to burglar alarm systems. Lights that have built in motion detectors, and thus come on when approached, were mentioned above. But it is even more effective to hook other sensors (such as an entire complex burglar alarm system) up to lights such that premises are lit when the burglar alarm is triggered. For the reasons discussed above, the lights (generally in combination with an audible alarm) tend to notify an intruder that he has been discovered and, hopefully, to cause him to desist and leave.

While it is known that light can be used as a deterrent, and even that flashing lights or other variants can be even better deterrents and may even tend to slightly, or even gravely, incapacitate, this knowledge has not been used to maximum effect. To the inventor's knowledge, all previously known applications have had some aspect which has either made them less than totally effective, or else has made them impractical. For example, the complex Rubstov invention, while undoubtedly effective, is too elaborate and expensive for many applications. As another example, household burglar alarms, while generally being reasonably inexpensive, also generally are fairly easily disabled Clearly, it would be desirable to use the known ability of lights to disorient and dissuade intruders in a cost effective and practical manner. However, to the inventors' knowledge, all prior art systems and methods have been less than totally effective and/or totally practical.

SUMMARY

Accordingly, it is an object of the present invention to provide an apparatus and method for using light to disorient intruders.

It is still another object of the present invention to provide an apparatus and method that is relatively inexpensive to implement It is yet another object of the present invention to provide an apparatus and method for using lighting that is generally used for general illumination purposes as a burglar deterrent mechanism.

Briefly, a known embodiment of the present invention is a lighting system that has a plurality of sensors for detecting the presence of persons in a plurality of areas. These sensors are used for a first purpose when the lights are in an illumination mode, but when the lights are "turned off", then the sensors remain active and cause the lights to flash brightly and rapidly when the presence of a person is detected in the corresponding area.

In this present example the illumination means is "LED" (light emitting diode) lighting, which lends itself well to instantaneous, rapid, or gradual changes in illumination level without loss of efficiency.

These and other objects and advantages of the present invention will become clear to those skilled in the art in view of the description of modes of carrying out the invention, and the industrial applicability thereof, as described herein and as illustrated in the several figures of the drawing. The objects and advantages listed are not an exhaustive list of all possible advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the described objects and/or advantages. Accordingly, the objects and/or advantages described herein are not essential elements of the present invention, and should not be construed as limitations.

DETAILED DESCRIPTION OF THE INVENTION

Figure 1:
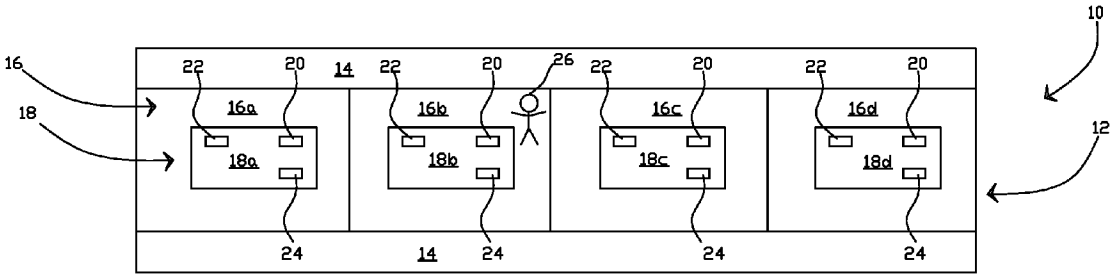
FIG. 1 is a diagrammatic top plan view of a store aisle illustrating a plurality of illumination zones as applied in the present invention.

This invention is described in the following description with reference to the Figures, in which like numbers represent the same or similar elements. While this invention is described in terms of modes for achieving this invention's objectives, it will be appreciated by those skilled in the art that variations may be accomplished in view of these teachings without deviating from the spirit or scope of the present invention.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

A known mode for carrying out the invention is accomplished by dividing a space into a plurality of zones. An example of an area divided into such zones is depicted in a top plan view in FIG. 1 and is designated therein by the general reference character 10. In this example, the area 10 is a store aisle 12, such as an aisle of a supermarket, or the like, although essentially any type of area that is divisible into zones and which may benefit by each zone being served by a separate device of some type is within the scope of the invention. In this example, typically the aisle 12 which comprises the interactive control area 10 of this example will be bordered by displays 14 which might include shelving, refrigerated storage displays, or the like.

As can be seen in the view of FIG. 1, the area 10 is divided into a plurality of zones 16 (four, in this present example, 16*a*, 16*b*, 16*c* and 16*d*). The quantity of zones 16 used for the present example is entirely arbitrary, and in practical applications, the size and quantity of zones will be selected to suit the application. Each of the zones 16 is serviced by a zone light 18 (18*a*, 18*b* and 18*c* and 18*d*, respectively).

While the zone lights 18 are depicted as being single separate units in the example of the top plan view of FIG. 1, in practical applications each zone light 18 may consist of a plurality of separate lights. Alternatively, in some cases, the zone lights 18 may appear to the viewer to be one continuous light fixture running the length of the aisle 12. In short, the zone lights 18 can be configured, as required, to properly illuminate the interactive control area 10. In any case, since in the present example the zone lights 12 use LED elements for illumination, it is likely that most zone lights 18 will each include a plurality of LED elements therein, such quantity being sufficient to provide the degree of illumination required.

For each zone light 18 there is a sensor 22 that senses the presence of a person in its respective zone 16*a*, 16*b*, 16*c* or 16*d*. Although motion detectors are commonly used in such applications, any of several types of sensors 22, existing or yet-to-be-invented, could be used to detect the presence of a person or persons within the zones 16.

As can be appreciated by one skilled in the art, particularly in view of the discussion of the inventive method hereinafter, each of the zone lights 18 will have to be capable of independently computing a proper light level. This means that each zone light 18 will have a processor 20 that is capable of rapidly performing complex computations but which, also, is both inexpensive (as there will be several to many of them in a complex system), and efficient in that it uses very little power. In the present example, a multi-core SEAforth™ processor, made by IntellaSys™ is utilized for the purpose, since it is very small, inexpensive, and uses very little power. Indeed, since it is completely asynchronous, it uses no power at all when it is not actually performing computations, and cores that are not actually presently in use no power even when other cores are actively engaged.

Since the example system described herein does not use a centralized controller, the zone lights 18 will, in most applications, require a means for communicating with each other and/or with an operator for adjusting and/or setting certain parameters of the zone lights 18. While this could be accomplished by hard wiring, it could also, and in the present example is, accomplished by a means for allowing each of the zone lights 18 to communicate wirelessly with its neighbor zone lights 18. Further, while such wireless communication could be accomplished using radio signals, infrared signals (where ambient conditions make this possible), or other such means. In the present example the means of communication is by a light sensor 24, which communicates with the processor 20. Signals can be sent by flashing one of the zone lights 18 so rapidly that it is imperceptible to humans. Such signals will be in the form of a timed series of flashes that is unique to each zone light 18, such that others of the zone lights 18 will know not only the information that is being sent (which, in this present example will be information pertaining to the presence of a person in another of the zones 16, but also which of the zone lights 18 is sending that information.

It should also be noted that, just because the zone lights 18 of the presently described example of the present invention operate generally without central control, that does not mean that it will not be desirable to have some means for a user to communicate directly with the zone lights 18, for purposes such as changing programming, instructions, or the like. This communication, also, could be accomplished by any of several means, including hard wiring, radio signals, or such, but in this present example this communication is also accomplished by flashing lights, which are perceived by the light sensors 24 and interpreted by the processor 20.

It should be noted that the information in the two paragraphs immediately preceding this should not be construed as being an aspect of the present invention. Rather, this brief overview of the control means involved in the "normal" functioning of the zone lights 18 is presented here merely as an aid to understanding the environment in which the invention, which will be described later herein, operates.

It should also be noted that the lights sensors 24 could be used for other purposes, such as for allowing the processors 20 to adjust the intensity of the zone lights 18 to account for variances in available ambient light, or the like.

Figure 2:
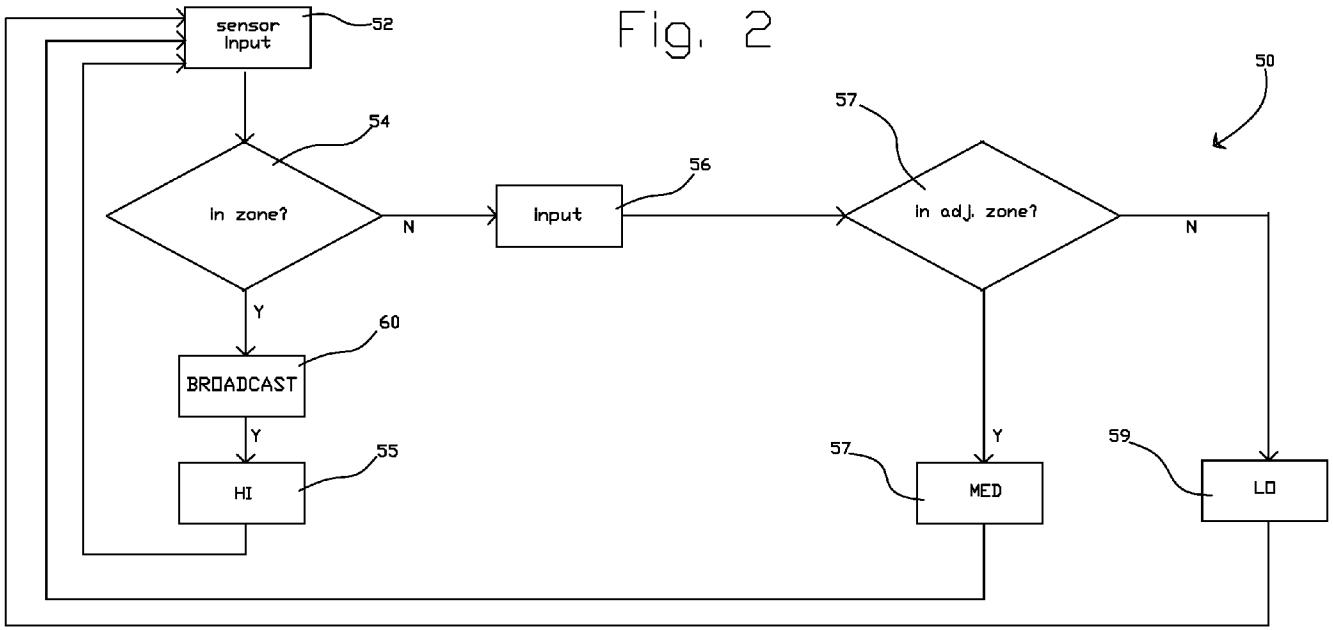
FIG. 2 is a flow diagram showing an example of a normal operating mode for the example illumination zones.

FIG. 2 is a flow diagram depicting an example of a variable control method 50 which is used to control the lighting in one example of a "normal" mode. By "normal", what is meant here is the mode in which the zone lights 18 function in their primary intended capacity—which is to illuminate their respective zones 16. The example of FIG. 2 employs quantities to correspond with the example of FIG. 1, and the variable control method 50 will be described, hereinafter, with reference both to FIG. 2 and to FIG. 1. Each of the operations described hereinafter are accomplished generally independently in each of the plurality of zone lights 18.

As can be seen in the view of FIG. 2, in a "sensor input operation" 52 input (consisting of an indication as to whether or not a person or persons is present in that particular zone 16 is provided from the respective sensor 22. Then, in an "in zone decision operation" 54, if there is a person or persons within the respective zone 16, then the illumination level of the corresponding zone light 18 will be set to high (HI 55). Also, In the "in zone decision operation" 54, if there is a person or persons within the respective zone 16, then, according to the method of FIG. 2, the fact of the presence of such person will be broadcast (in this example, by flashing at high frequency in an identifiable pattern) to all those zone lights 18 with which the present zone light 18 is in communication in a "broadcast operation" 60.

If there is no person in the respective zone 16 then, in a "receive input operation" 56, information is received from neighboring zone lights 18 as to whether a person is present within their respective zones 16. It will be noted that several potential problems are involved here which have been addressed by the inventors as follows: As previously described herein, each zone light 18 must be able to particularly identify its neighbors, and this is accomplished by assigning a unique identification flash pattern to each zone light 18. But also, there is the problem that, particularly in large installations, several zone lights may be attempting to communicate simultaneously and it might, therefore, be difficult to decipher the signals at all. Fortunately, a relatively slow response, on the order of more than a second, is acceptable in this particular application. Therefore, there is time for one, or even several, unsuccessful attempts. According to this particular embodiment of the invention, the inventors have found that causing each of the zone lights 18 to broadcast its status at quasi-random intervals ranging from 0.5 seconds to 1.5 seconds, will be more than sufficient to insure, with a high degree of probability, that a successful communication will occur between any two particular zone lights 18 within two seconds. Alternatively, a light shield could be used around the light sensor 24 to make it directionally sensitive, thus generally insuring that any signal received would be from the zone light 18 toward which it is pointed. This is, by no means, an exhaustive list either of the method and means for communicating between the lights, or for the method and/or means for managing communications so as to avoid clashes, and the like.

In an "adjacent zone decision operation" 57 if there is a person or persons in any zone 16 adjacent to the zone 16 presently under consideration, then the illumination level of the present zone light 18 will be set to a medium value (MED 57). If there is no person or persons either in the particular zone 18 under consideration nor in a zone 18 adjacent thereto, the illumination level of the present zone light 18 will be set to a low value (LO 59). The variable control method is repeated, indefinitely, as long as the zone light 18 is in operation in the above described "normal" mode.

To illustrate, by example, the above operation, in the view of FIG. 1 a diagrammatic person 26 is illustrated in zone 16*b*, and no other persons 26 are present in the aisle 12. In this case, the zone light 18*b* would set itself to high, the zone lights 16*a* and 16*c* would be set, according to their own calculations, to a medium value, and the zone light 18*d* would set itself to a low value, since there are no persons 26 either in its own zone 16*d* nor in any adjacent zone 16.

Note that while the example illustrated by FIG. 2 shows one way to accomplish the desired objective, the essence of the present invention lies in the fact that a zone 18 with a person or persons therein will have a first (high) illumination level, a zone 18 with a person or persons in an adjacent zone will have a second (medium) lighting level, and zone with no person or persons in that zone or in adjacent zones will have a third (low) lighting level, and all of this is accomplished without any centralized control. That is, the devices (zone lights 18, in this present example) make their own decisions, and they gain the information necessary to make those decisions by communication with other such devices.

In the present example, a HIGH 55 illumination level will be essentially 100% of the illumination level of which each of the zone lights 18 is capable; MED 57 illumination level will be approximately 75%. And LO 59 will be approximately 50%. However, it should be noted that these values are examples only. Indeed, in a particular application the values might be "tweaked" at very fine levels to achieve the desired lighting effect. Indeed, one of the advantages for using a processor such as the IntellaSys™ SEAforth™ chip is that the illumination of each zone 16 of each interactive control area 10 can be individually controlled, as desired. As just one example, in some applications it might be decided that the proper level for LO 59 would be 0%.

It should be noted that, in this present example, no separate signal to voltage converter(s) are shown, because it is assumed that such devices are embedded and are a part of each of the zone lights 18. Furthermore, the present invention is not limited by the dimming apparatus, or other such method or means as may be employed to change the brightness or other characteristics of the lights. Indeed, it is contemplated by the inventors that dimming means such as duty cycle modulation, or the like, may be employed to control the relative brightness of lights.

Figure 3:
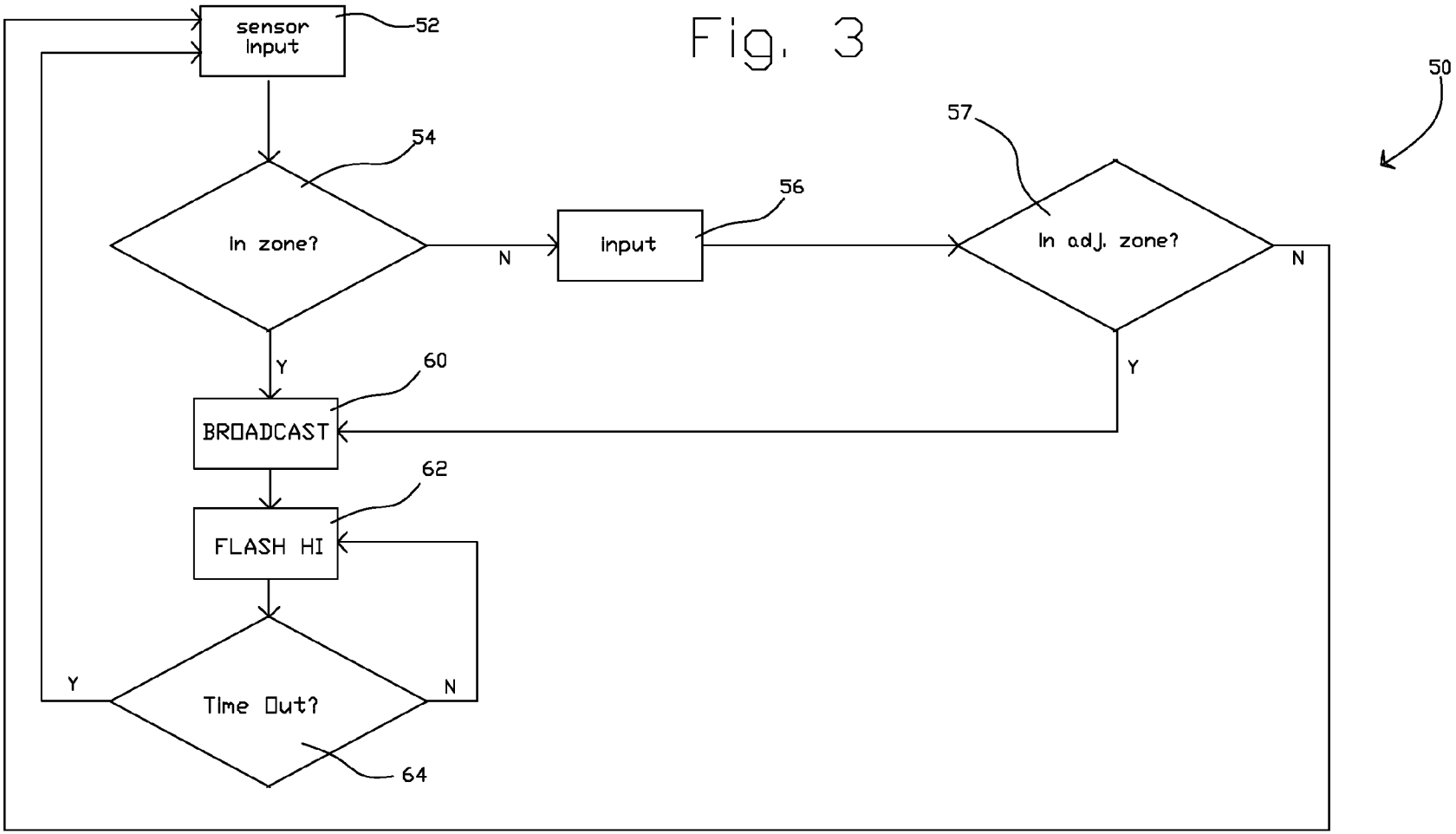
FIG. 3 is a flow diagram showing an example of a "lights off" mode, according to the present invention.

The above description relating to FIG. 2 provides a "normal" operation setting in which the present invention is, in this present example, embodied, although many variations of this "normal" environment could be applied without altering the value and scope of the present invention. The method and apparatus described thus far herein describe a situation in which, for example, a store is open and ready to accept customers. FIG. 3 is a flow diagram depicting a "lights off" mode of operation that will be referred to herein as a security method 70. This security method 70 is intended to be used, for example, when the store is closed and no one should be present therein. The flow chart of FIG. 3 describes a loop of operations that occur after the store is closed and the zone lights 18 are set as the user desires for the night. It should be noted that the zone lights 18 might be set by the user to be off, to be on at some dim level, or even for some of the lights to be on and some off. The exact conditions for the lights will be according to the application and the desires of the user, and the method and means for setting these lights in such "night" mode are not an aspect of the present invention. Indeed, the present invention is intended to function regardless of the preset conditions from which the inventive method is initiated.

Beginning with the zone lights 18 in a night mode, as described above, the sensors 22, just as they did in relation to the method depicted in FIG. 2, sense for the presence of a person 26 in the respective zone 16 in the "sensor input operation" 52. In the "in zone decision operation" 54, if there is a person or persons within the respective zone 16, then, according to the method of FIG. 3, the fact of the presence of an intruder will be broadcast (in this example, by flashing at high frequency in an identifiable pattern) to all those zone lights 18 with which the present zone light 18 is in communication in a "broadcast operation" 60. (As described above, this will be its "neighbors".) Also as described above, in this present embodiment the broadcast consist of an identifiable flashing of the zone light 60 as a signal that can be identified and interpreted by the neighboring zone lights 18. Also, the present zone light 18 will begin to flash rapidly and brightly according to the "flash high operation" 62 in FIG. 3. More about the speed and other characteristics of such flashing will be discussed hereinafter.

Returning to a discussion of the flow diagram of FIG. 3, if no intruder is detected at a given zone light 16 in the "in zone decision operation" 54 then, just as described in relation to FIG. 2, in a "receive input operation" 56 the zone light 18 looks for input from its neighbors. (That is, the zone light 18 attempts to detect if any of its neighbors are broadcasting the detection of an intruder, as described by the "broadcast operation" 60 in as applies to this particular zone light 18. If, in the "adjacent zone decision operation" 57, it is determined that there is an intruder in an adjacent zone 16, then the second (neighbor) zone light 18 will broadcast that information to its own respective neighbors, as represented by the "broadcast operation" 60. Then, the neighbor zone light 18 will begin to flash brightly as represented by the "flash hi" 64 operation. In this manner, the fact of presence of an intruder in any one zone 16 will be broadcast about the entire premises until all of the zone lights 18 that are in communication, either directly, or indirectly through still other of the zone lights 18, are flashing.

As can be seen in the view of FIG. 3, for each of the zone lights 18 that is performing this method, there is a "time out decision operation "64" wherein it is determined if a present time has elapsed since the "flash high operation" 62 commenced. If such time has elapsed, then in a "flash off operation" 66 the zone light 18 will cease to flash and the process will begin again with the "sensor input operation" 52.

It should be noted that, according to this presently described embodiment of the invention, the flashing of various zone lights 18 is not synchronized. That is, each will begin to flash when individually activated, and each will flash at its own particular rate. This rate could be somewhat random, but in this described embodiment the respective flash rates of different zone lights 18 is purposely set at different frequencies, varying from approximately 20 flashes per second to as low as 1 flash per second, as it is thought by the inventors that this disparity in flash rates will make the flashing lights even more disruptive and disconcerting to the intruder.

As can be appreciated in light of the above description, an intruder might, in some circumstances, cause the flashing lights to eventually stop by remaining motionless (if the sensors 22 are simple motion detectors), or by hiding temporarily out of the view of the sensors 22 until the zone lights 18 stopped flashing. However, in such case, the intruder would be somewhat trapped, for as soon as he or she began to move again, the whole process would start again. It would begin again to flash—first locally and then spreading out to all the zone lights 18, as described above.

Various modifications may be made to the invention without altering its value or scope. For example, while the embodiment described herein has specifically been described such that the flashing of the zone lights 18 is not synchronized, it might be desirable in some applications to synchronize the flashing, so as to intensify the effect. Further, while the presently described embodiment is such that the effect is, eventually, spread throughout the entire premises, it might be desirable in some applications to limit the scope of the effect such that the flashing lights might seem to follow an intruder as he or she moves about the premises. Furthermore, while this invention has been described herein in terms of lighting the aisles 12 of a store, many other environments, such as homes, could benefit from the advantages provided by the present invention. All of these are minor technical variations that could easily be accomplished to achieve the desired effect in a particular application While specific examples of the inventive security method 70 and related apparatus have been discussed therein, it is expected that there will be a great many applications for these which have not yet been envisioned. Indeed, it is one of the advantages of the present invention that the inventive method and apparatus may be adapted to a great variety of uses.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive security method 70 and associated apparatus are intended to be widely used in a great variety of applications. It is expected that it they will be particularly useful in applications wherein modern, efficient lighting is installed. In such installations, the marginal cost of adding these important security features would be almost nothing. Since this important additional feature can be provided and such little cost, it is thought that the incentive to upgrade and/or install more efficient lighting will be greatly enhanced, thereby significantly contributing to the environment and the economy.

It should be noted that the present invention is but one example of an enhancement that can be added to a lighting system. Other such enhancements include, but are not limited to: (a) Using the light sensors 24 such that the user can set a desired overall light level and the light sensors 24 would then adjust the output of their respective zone lights 18 to account for changes in ambient light; (b) Replacing the separate sensor 22 with a variant of the light sensor 24 such that the presence of an intruder is detected by changes in reflectance of the light emitted from the respective zone light 18; (c) As mentioned briefly previously herein, using pulse width modulation to vary the intensity of the zone lights 18; (d) Using the zone lights 18 to highlight particular displays 14 or to "lead" the customer to such displays 14 by making the lighting more attractive or more pleasant in a particular portion of the aisle 12; (e) Integrating other appliances, such as a heating/cooling system, audio announcements regarding particular displays, or many other such devices, into the interactive control area 10 system, such that these systems could take advantage of the non-centralized control as recited herein.

According to the present inventive method and apparatus, a highly effective burglar control system can be integrated into the lighting system at very marginal cost. Such burglar control systems will be both inexpensive and also substantially more effective than comparable prior art systems, except perhaps for very expensive systems.

Since the zoned interactive security method 70 and associated apparatus of the present invention may be readily produced and integrated with existing architectural spaces, and the like, and since the advantages as described herein are provided, it is expected that they will be readily accepted in the industry. For these and other reasons, it is expected that the utility and industrial applicability of the invention will be both significant in scope and long-lasting in duration.

We claim:

1. A lighting system for detecting the presence of an intruder, comprising:

a first light apparatus having a first light, a first intrusion sensor for detecting the presence of the intruder, and a first processor for causing the first light to flash when the first sensor does detect the presence of the intruder;

and a second light apparatus having a second light, a second processor and a light sensor for sensing a signal from the first light apparatus, wherein the second processor causes the second light to flash when the light sensor detects the signal from the first light apparatus.

2. The lighting system of claim 1, wherein:

the first light apparatus signals the second light apparatus by flashing the first light in an identifiable pattern.

3. The lighting system of claim 2, wherein the identifiable pattern is a specific flash rate.

4. The lighting system of claim 1, wherein:

the first light apparatus has a first apparatus light sensor;

the second light apparatus has a second intrusion sensor; and when the second intrusion sensor detects the presence of the intruder then the second light flashes and the flashing of the second light is detected by the first apparatus light sensor; and the first processor then causes the first light to flash.

5. The lighting system of claim 1, and further including:

a third light apparatus having a third light, a third processor and a third light sensor for sensing a signal from either of the first light apparatus or the second light apparatus, wherein the third processor causes the third light to flash when the third light sensor detects the signal from either of the first light apparatus or the second light apparatus.

6. The lighting system of claim 1, wherein:

the first intrusion sensor is a motion detector.

7. In a lighting system having a plurality of lights, a like plurality of intrusion detectors, each intrusion detector being associated with one of the lights, a like plurality of processors each of which is connected to cause an associated one of the lights to flash when its respective intrusion detector is activated, a like plurality of sensors for sensing when one or more of the other lights is signaling, each of said sensors being connected to an associated one of said processors, a method comprising:

when one of said sensors senses that one or more of the other lights is signaling then its associated processor causes its associated light to flash; and the signaling is accomplished by causing one or more of the lights to flash in an identifiable pattern.

8. In a lighting system having a plurality of lights, and a plurality of detectors such that the intensity of the lights can be caused to vary depending upon input from the detectors, an improvement comprising:

providing a night mode such that when the lights are off and further when any one of the detectors is activated then that detector causes a processor to flash at least one of the lights, and further including;

providing a plurality of signal detectors, each of said signal detectors being associated with at least one of the plurality of lights such that when any of the signal detectors detects a signal from any of the other lights then the light associated with that signal detector is caused to flash; wherein;

the signal detectors are light detectors, each coupled to an associated processor; and the signal from any of the other lights is in the form of flashing light.

9. In a lighting system having a plurality of lights, an improvement comprising:

a like plurality of intrusion detectors, each intrusion detector being associated with one of the lights;

a like plurality of processors each of which is connected to cause an associated one of the lights to flash when its respective intrusion detector is activated;

a like plurality of sensors for sensing when one or more of the other lights is signaling, each of said sensors being connected to an associated one of said processors such that when one of said sensors senses that one or more of the other lights is signaling then its associated processor causes its associated light to flash, said signaling being one or more of the lights flashing in an identifiable fashion.

* * * * *